US005181465A

United States Patent [19]

Fitzgibbons et al.

[11] Patent Number: 5,181,465

[45] Date of Patent: Jan. 26, 1993

[54] RIBBON GUIDE SYSTEM FOR A LINE PRINTER

[75] Inventors: Patrick J. Fitzgibbons, Newark Valley, N.Y.; Ho C. Lee, Endicott, N.Y.; Lawrence A. Stone, Cary, N.C.; Paul C. Van Note, Johnson City, N.Y.

[73] Assignee: International Business Machines Corporation, Armonk, N.Y.

[21] Appl. No.: 845,403

[22] Filed: Mar. 3, 1992

[51] Int. Cl.[5] ..... B41J 27/00

[52] U.S. Cl. ..... 101/103; 400/224; 400/248

[58] Field of Search ..... 101/103, 120, 100, 107; 400/248, 248.1, 248.2, 247, 224

[56] References Cited

U.S. PATENT DOCUMENTS

| | | | |
|---|---|---|---|
| 674,312 | 5/1901 | Febel | 400/216.6 |
| 1,031,541 | 2/1912 | Duncan | 400/224 |
| 2,128,267 | 8/1938 | Sacerdote | 400/248 |
| 2,554,028 | 5/1951 | Helmond | 400/235.1 |
| 2,734,615 | 2/1956 | Wallendael | 400/224 |
| 3,022,724 | 3/1962 | Worth | 400/248 |
| 3,062,351 | 11/1962 | Canny | 400/219.2 |
| 3,104,750 | 9/1963 | Canny et al. | 400/214 |
| 3,158,093 | 11/1964 | Carlson | 400/224 |
| 3,424,292 | 1/1969 | Goff, Jr. et al. | 400/208.1 |
| 3,464,533 | 9/1969 | Gallant | 400/208 |
| 3,835,770 | 9/1974 | Shimodaira et al. | 101/107 |
| 3,991,676 | 11/1976 | Sasaki | 101/107 |
| 4,044,677 | 8/1977 | Hamisch, Jr. | 101/103 |
| 4,981,379 | 1/1991 | Fujimoto et al. | 400/248 |

FOREIGN PATENT DOCUMENTS

| | | | |
|---|---|---|---|
| 0005977 | 1/1986 | Japan | 400/247 |
| 0057376 | 3/1986 | Japan | 400/224 |
| 0009673 | 1/1990 | Japan | 400/248 |

OTHER PUBLICATIONS

IBM Technical Disclosure Bulletin vol. 31, No. 10, Mar. 1989, "Ribbon Spool Drive System", by Engle et al.

*Primary Examiner*—Edgar S. Burr
*Assistant Examiner*—Anthony H. Nguyen
*Attorney, Agent, or Firm*—John S. Gasper

[57] ABSTRACT

A printer apparatus has a frame member supporting an endless revolving type band in alignment with a row of print hammers with a gap therebetween. Ribbon spools with ribbon wound thereon are rotatably supported in spool housings at either end and on opposite sides of the frame member. The spool housings each have a receptacle portion and a cover portion which enclose the spool. A gap in the spool houses enables the ribbon to extend between the housing and through the gap. The ink ribbon is guided through the gap in parallel with the row of hammers and at an angle to the print line by a set of guide pins on the cover of one spool housing and a set set of guide pins mounted on the frame member in proximity with the other spool housing. Both sets of guide pins engage the same side of the ink ribbon in a manner whereby touching the ribbon is not required to install or remove the ribbon from the printer apparatus. Individual drive motors for rotating the ribbon spools are mounted on the receptacles of the spool housings.

12 Claims, 8 Drawing Sheets

RIBBON GUIDE SYSTEM FOR A LINE PRINTER

This invention relates to printer apparatus and particularly to a ribbon guide system for a line printer. The invention has utility in high speed line printers but in not necessarily limited thereto.

BACKGROUND OF THE INVENTION

High speed impact line printers comprise an endless type carrier band with a single row of characters moving parallel with a row of print hammers. The band is trained on spaced drive and idler or tension pulleys which are motor driven to revolve the band at constant speed. The band drive, as it is commonly called, is generally mounted on a support or frame member that holds the band in proximity to the row of print hammers mounted on another frame member. The hammers and the band are separated by a gap or throat which defines a passageway for a print medium such as paper forms and an ink ribbon.

The printing ribbon is sometimes a narrow strip wound on two widely separated spools with a section extending across the paper and lengthwise through the gap. Commonly the ribbon path is slanted relative to the line of the hammers and type band so that the entire width of the ribbon is presented for printing. Ribbon drive motors rotate the spools to feed the ribbon through the gap. Guide means between the spools is provided for maintaining the ribbon in proper alignment as it travels through the gap. The guide means necessarily are also widely separated to avoid interference with the hammer and paper feed operations and hence maintaining the ribbon on track presents a problem. The structures and arrangement of the guide means and the spool mountings have made it necessary to manually touch the ribbon when the ribbon is replaced and/or installed. The publication in the IBM Technical Disclosure Bulletin Vol. 31, No. 10, March 1989 pp. 32–33, shows a printer unit in which the type band drive is mounted on a frame above the horizontal paper path. A stretch of the ribbon between ribbon spools passes horizontally between the type band and paper. No guidance structure is shown. The ribbon spools are inserted into enclosures on either side of the paper path frame. Such an arrangement is not convenient because of space limitations if the print unit is located within a cabinet and the direction of paper feeding is from side to side instead of front to back.

SUMMARY OF THE INVENTION

The invention provides a printer apparatus having a printing ribbon drive and guidance system that does not require finger contact with the ribbon itself when installing the ribbon. Basically this is accomplished in accordance with the invention by providing an assembly in which the band drive and the ribbon drive are mounted on a common support member which supports the band drive above a horizontal row of print hammers. The support for the band drive and the ribbon drive comprises a frame member with gap therebetween. The ribbon drive comprises spaced apart ribbon spool housings mounted on either side of the frame member at opposite ends of the type band. A ribbon guidance system comprises movable ribbon guide means mounted on one spool housing and a fixed guide means mounted on the frame member. Each ribbon guide means comprises a series of guide elements with guide surfaces arranged to maintain the ribbon aligned with the spools and parallel within the gap with the type band and row of print hammers. The guide means includes a transition guide element between the other guide elements so that the ribbon can move therebetween in such a way that the configuration of the ribbon is distortion free and compatible with stable ribbon tracking.

It will be seen that the invention provides a ribbon drive assembly arrangement which is simple in construction and easy to use to assemble and remove ink ribbon from a printer apparatus. Other advantages will become apparent from the detailed description which follows.

DETAILED DESCRIPTION OF THE INVENTION

Figure 1:
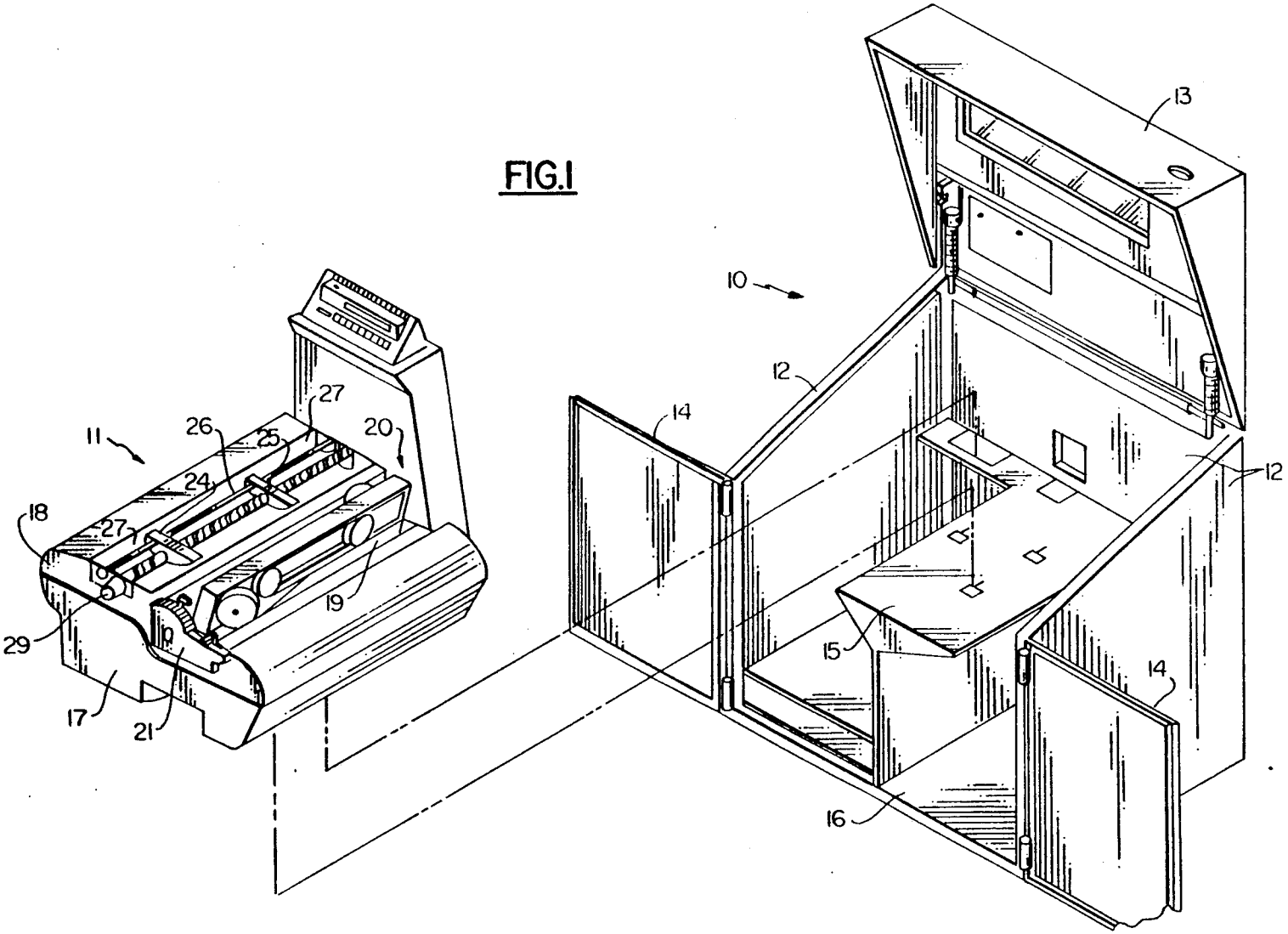
FIG. 1 is an exploded three dimensional view of a printer apparatus of the type in which the invention can be used.
Figure 2:
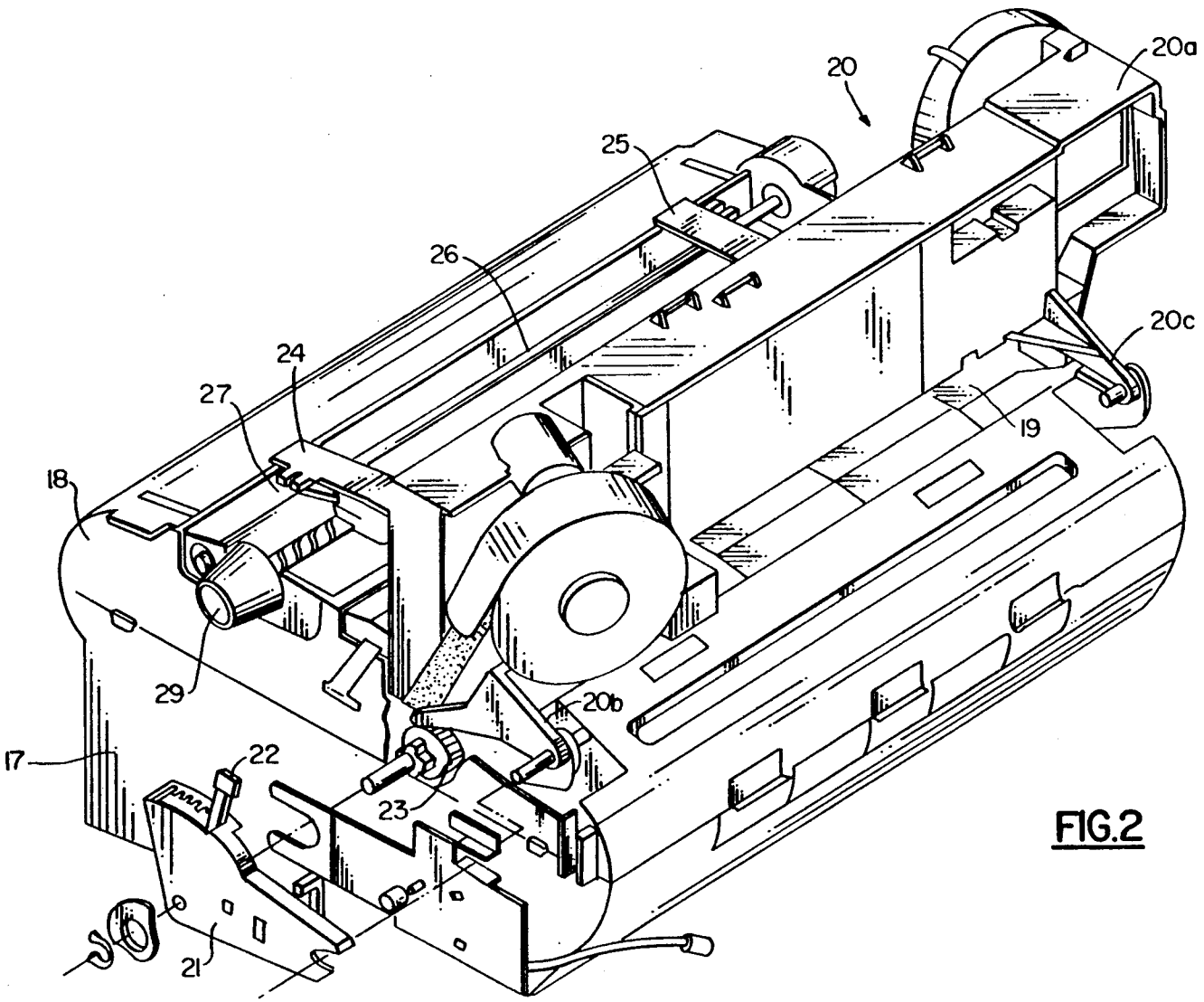
FIG. 2 is a perspective view of the print unit portion of the printer apparatus of FIG. 1.

As seen in FIG. 1, a printer apparatus comprises cabinet 10 within which is installed a print unit 11. The cabinet 10 has side walls 12 on which top door 13 and a pair of front doors 14 are hingedly attached. A pedestal 15 on bottom wall 16 supports print unit 11 within the cabinet 10. When installed in cabinet 10, print unit 11 prints on paper fed from side to side so that stacks of folded paper (not shown) would rest on bottom wall 16 on the right and left sides of pedestal 15.

Print unit 11 includes a casing having a base 17 and cover 18 on which is mounted a hammer unit 19. Mounted on hammer unit 19 is band and ribbon drive assembly 20 which in accordance with this invention comprises frame member **20*a* on which is supported both the type band drive and ink ribbon drive system. As described in copending application Ser. No. 07/664,255 filed Mar. 4, 1991, now U.S. Pat. No. 5,108,205 issued on Apr. 28, 1992, frame member 20*a* has pivot arms 20*b* and 20*c* pivotably mounted on hammer unit 19 so that an adjustable gap exists for the passage of the ink ribbon and paper to be printed on. The gap adjustment mechanism includes levers 21 and 22 for rotating cam 23 as more fully described in said copending application. The paper feed mechanism comprises pin belt tractors 24 and 25 which engage edge perforations in the paper and which are adjustably spaced along drive shaft 26 by dual coaxial rotatable lead screws 27 and 28 operated by knob 29 as more fully described in copending application Ser. No. 7/662,863 filed on Mar. 1, 1991. The tractors 24 and 25 feed paper across the top of cover 18** and over the hammer unit so that the paper movement is from side to side through the print unit as previously mentioned.

Figure 3:
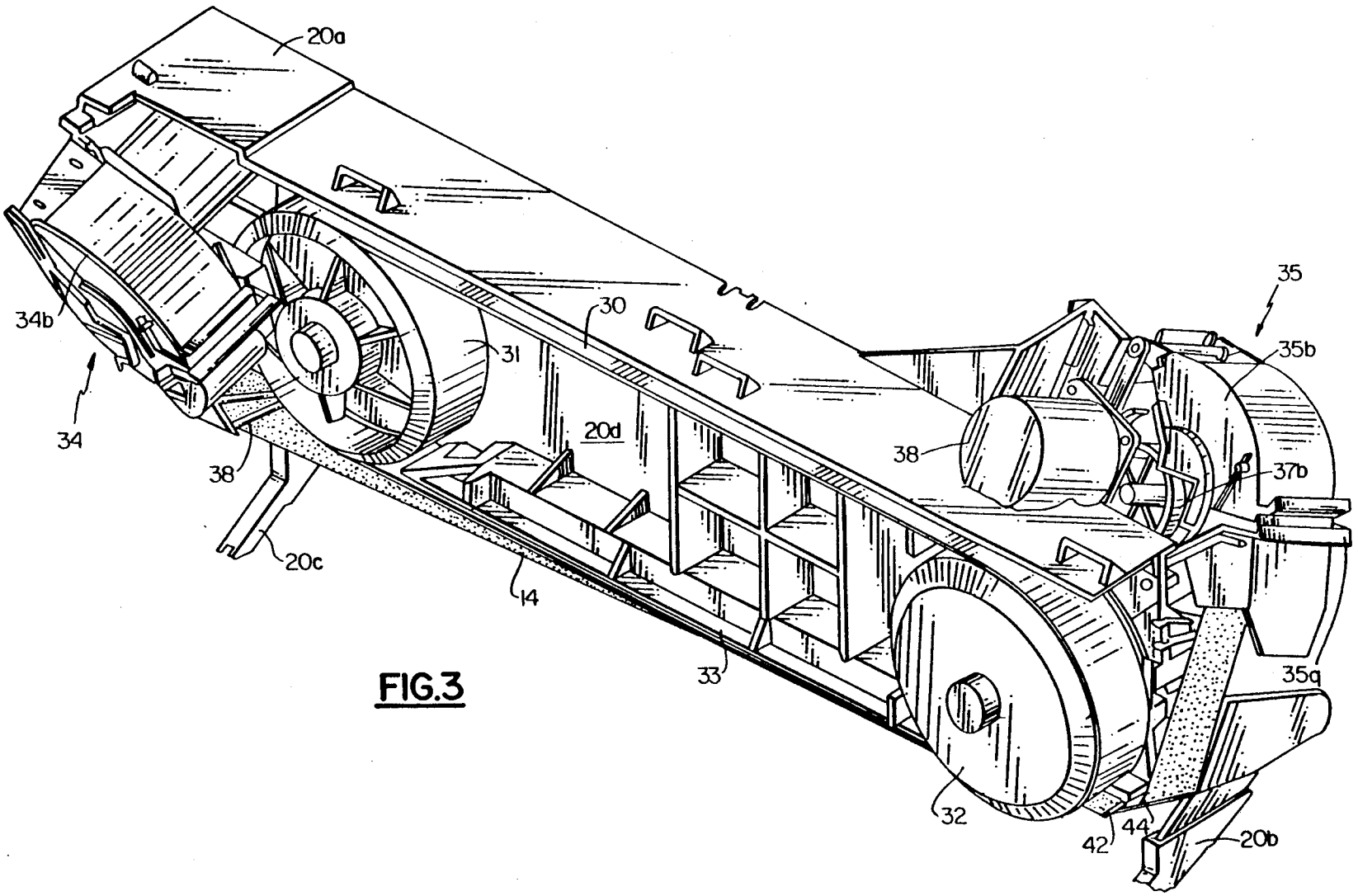
FIG. 3 is a perspective view of the ribbon drive and band drive assembly portion of the print unit of FIG. 2.
Figure 4:
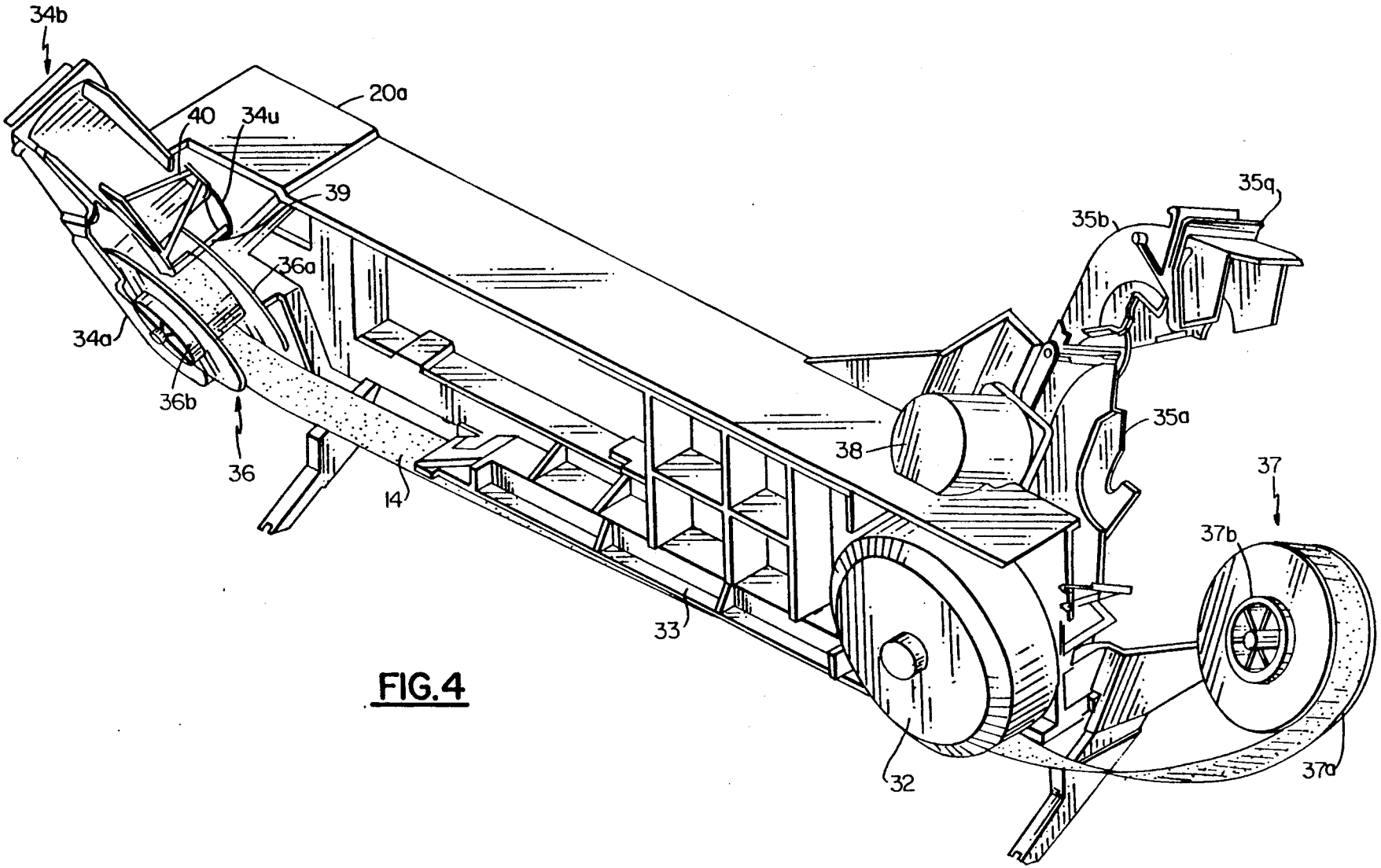
FIGS. 4 and 5 are sequential perspective views of the ribbon drive and band drive assembly of FIG. 3 for illustrating the process for manually removing and installing a ribbon in accordance with the invention.

As best seen in FIG. 3, frame member 20*a* is a plate-like casting on which are mounted both the band drive and the ribbon drive. The band drive comprises endless type band 30 wrapped around a pair of drive pulleys 31 and 32 mounted on one side 20*d* of frame member 20*a* and could include an electric motor (not shown) mounted on the other side of frame member 20*a* and connected to one of the drive pulleys for rotating type band 30 at constant speed. A shelf-like platen 33 between the pulleys 31 and 32 at the bottom edge of the casting 20*a* provides backup to the type band 30. Platen 33 has a surface which, when frame member 20*a* is mounted on cover 18 of print unit 11, extends over a distance which is at least co-extensive with the row of print hammers 19.

Figure 7:
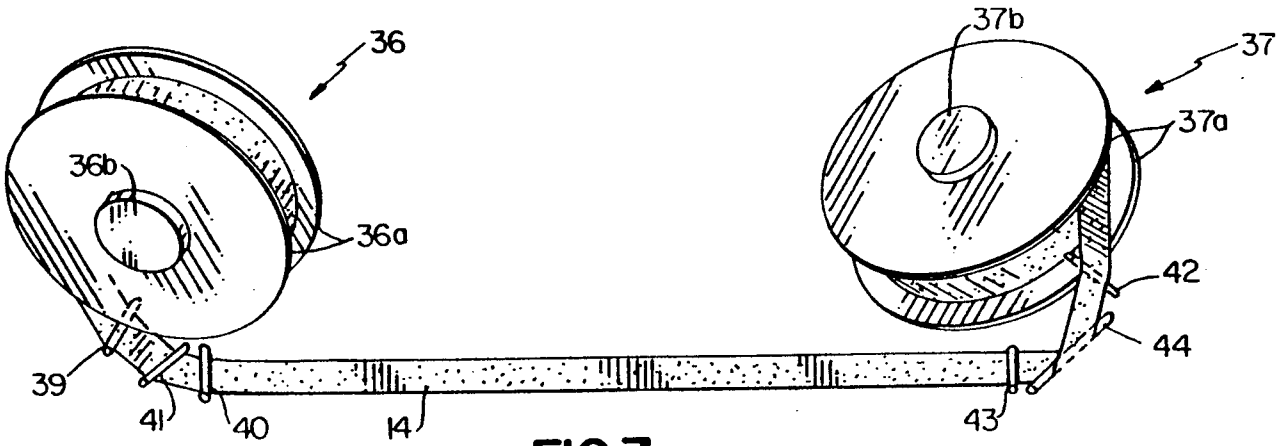
FIG. 7 is a perspective view of the ribbon and spools only for the purpose of illustrating the ribbon guide system of the invention.

As seen in the various figures, the ribbon drive comprises ribbon spool housings 34 and 35 mounted on opposite sides of frame member 20*a* at opposite ends of the type band 30. This enables ribbon 14 to be fed lengthwise through the gap at an angle to the print line formed by the row of hammers and the single row of characters on band 30 so that substantially the entire width of the ribbon 14 is presented for printing. Ribbon spool housings 34 and 35 are also tilted at an angle away from the vertical plane of frame member 20*a*. The degree of tilt can vary depending on the amount of space available between the top of the print unit 11 and the cover of cabinet 10. Tilting also enhances positioning and directing of ribbon 14 toward the path of travel as will be more fully understood hereinafter. When print unit 11 is contained in cabinet 10 as previously described, spool housings 34 and 35 are the back and front ribbon housings respectively. Mounting spool housings 34 and 35 on frame member 20*a* makes them more accessible for installing and replacing ribbon 14 within the print unit 11. Located within the spool housings 34 and 35 are spools 36 and 37 on which ink ribbon 14 is wound with a stretch of ribbon extending therebetween (see FIG. 7). Spools 36 and 37 are any well known type having flanges 36*a* and 37*a* with external gears 36*b* and 37*b* and stub shafts. Mounted on spool housing 35 is drive motor 38 having a pinion gear (not shown) which engages gear 37*b* on spool 37. Similarly, a drive motor (not shown) is mounted on ribbon spool housing 34 with the same gearing for engaging gear 36*b* on spool 36.

Figure 8:
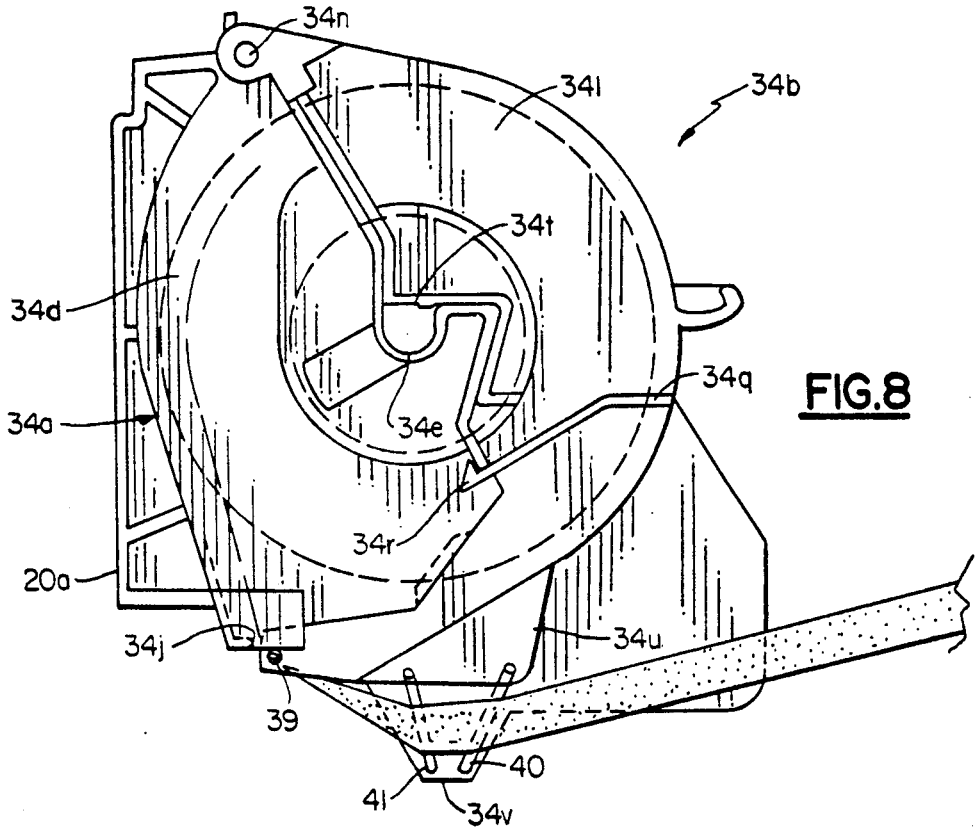
FIG. 8 is an elevational view showing one of the ribbon spool housings with the ribbon spool housed therein.
Figure 10:
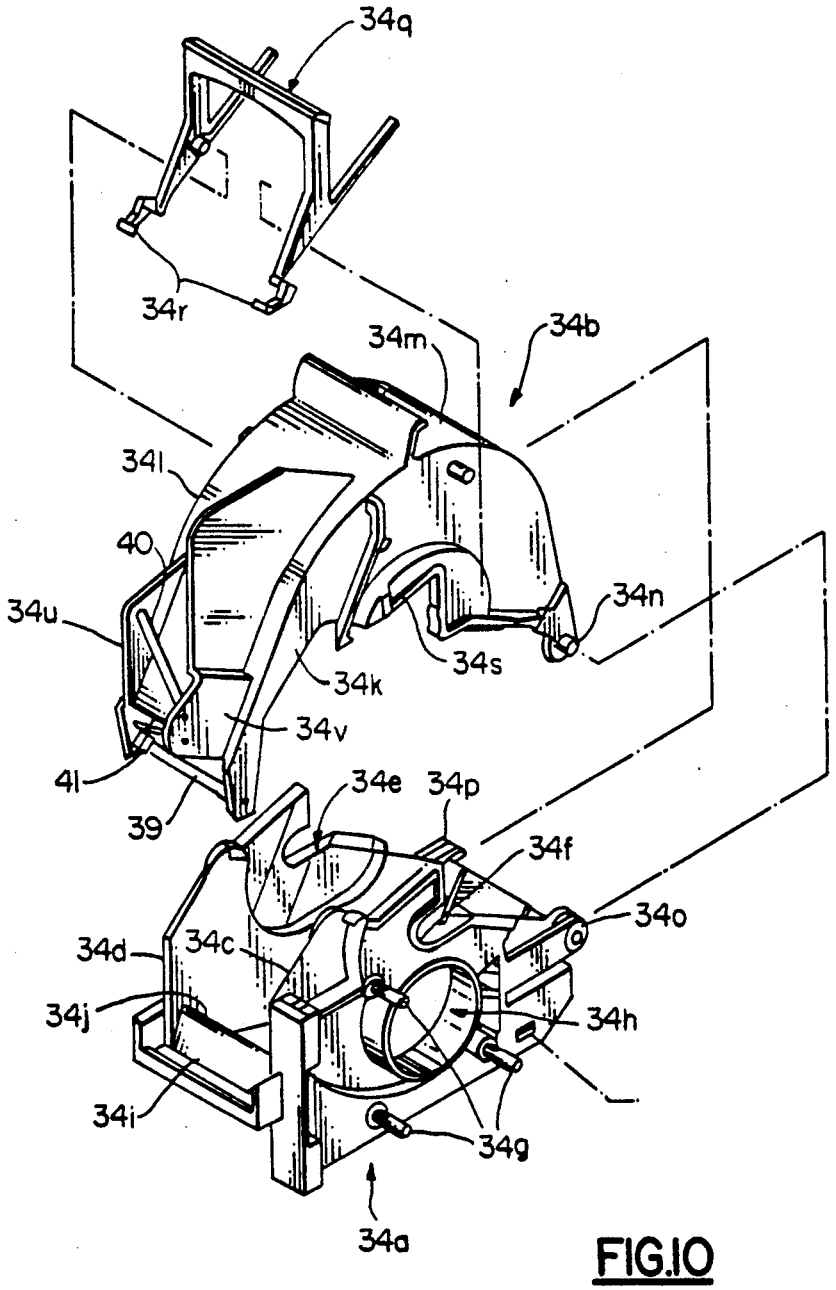
FIG. 10 is a three dimensional exploded view of the ribbon spool housing of FIG. 8.

As seen in FIGS. 8 and 10, back spool housing 34 comprises housing or receptacle member 34*a* and cover member 34*b* hingedly connected thereto so that ribbon housing 34 can be opened and closed. Housing member 34*a* has parallel sidewalls 34*c* and 34*d* with saddle bearings 34*e* and 34*f* in which stub shafts on spool 36 rest when spool 36 is installed between sidewalls 34*c* and 34*d*. Pins 34*g* on sidewall 34*c* around opening 34*h* serve as the mount for a drive motor so that gearing on the motor shaft extending through opening 34*h* makes a drive connection with the gearing 36*b* on spool 36 when spool 36 is placed in housing member 34*a*. Between sidewalls 34*c* and 34*d* is cross member 34*i* with bearing edge 34*j* which engages the bottom side of ribbon 14 where it exits from inside the spool housing 34. Bearing edge 34*j* is concave to center the ribbon relative to the spool 36.

Cover member 34*b* comprises parallel side walls 34*k* and 341 and curved end wall 34*m*. The hinge connection for movement of cover member 34*b* between closed and open positions comprises hinge pins 34*n* on sidewalls 34*k* and 341 of cover member 34*b* and hinge elements 34*o* and 34*p* on sidewalls 34*k* and 341. Cover member 34*b* is locked in closed position or unlocked by operating latch element 34*q* pivoted on the sidewalls of cover member 34*b* and which has hooks 34*r* which engage housing member 34*a* in closed position. When closed, bearing edges 34*s* and 34*t* on the sidewalls 34*k* and 341 of cover member 34*bx* close the saddle bearings 34*e* and 34*f* so that spool gear 36*b* is brought into engagement with gearing on the drive motor shaft and the stub shafts on spool 36 are captured in place.

In accordance with this invention, a movable ribbon guide is provided at one end of the type band 30 which, in the preferred embodiment, comprises a series of guide pins 39, 40 and 41 fixedly attached between external flanges 34*u* and 34*v* at the swing end of cover member 34*b*. Flanges 34*u* and 34*v* form a ribbon channel in which the stretch of ribbon 14 proximate spool housing 34 is caught for engagement with and positioning by the guide pins 39–41 when cover member 34*b* is swung from open to closed position. Conversely, when cover member 34*b* is unlocked and swung open, the ribbon 14 in proximity with spool housing 34 is disengaged from guide pins 39–41 and removed from the ribbon channel formed by flanges 34*u* and 34*v* on cover member 34*b* and is thereby removable without hindrance when spool 36 is removed from housing member 34*a*. Likewise, when cover member 34*b* is opened, flanges 34*u* and 34*v* present no hindrance to the ribbon 14 when spool 36 is to be installed into housing member 34*a*.

As seen in the various figures, guide pins 39–41 have different angular orientations. Pin 39 is attached to flanges 34*u* and 34*v* so as to present a guide surface parallel with the axis of spool 36. This parallelism assures ribbon is properly aligned with the spool 36 in housing 34. Pin 39 is also located when cover 34*b* is closed so that it coacts with bearing edge 34*j* to engage opposite surfaces of ribbon 14 so that ribbon 14 moves through a bend which applies some amount of tautness to ribbon 14 as it leaves spool housing 34. Guide pin 40, mounted on the brackets 34*u* and 34*v* so that when cover member 34*b* is closed, pin 40 presents a guide surface that is normal to ribbon 14 and that is parallel with the surface of the row of hammers 19 and the face of type band 30 and since ribbon 14 is slanted at an angle relative to the print line as previously described, guide pin 40 in being normal to ribbon 14 is also slanted a corresponding amount relative to the print line. Guide pin 41 serves as a transition pin for guiding the ribbon 14 from the plane of pin 39 to the plane of pin 40 and is slanted in such a way that the ribbon 14 moves through the guide without wrinkling, folding or tearing at the edges. The proper orientation is determined by requiring that when the ribbon 14 is stretched over 39–41 with opposite forces perpendicular to pins 39 and 40 respectively, the resulting tension will not urge the ribbon to move up or down along the pins 39 or 40.

Figure 9:
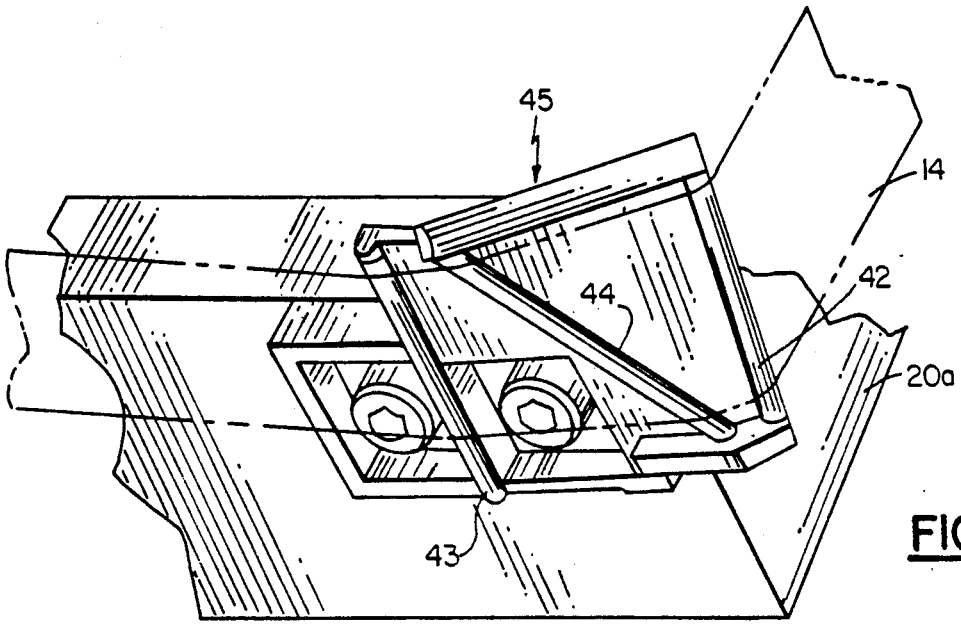
FIG. 9 is an enlarged perspective view showing the fixed ribbon guide.

The front spool housing 35 comprises housing or receptacle member 35*a* and cover member 35*b* hingedly connected thereto. Spool housing 35 is the same as back spool housing 34 in all respects except that cover member 35*b* has a bearing edge near the swing end which when closed coacts with a concave bearing edge of the housing member 35*a* to provide for reverse bending of the ribbon 14 as it leaves spool housing 35 and no ribbon guide is attached to cover member 35*b*. Instead a fixed ribbon guide is provided at the end of type band 30 for engaging ribbon 14 proximate spool housing 35. As best seen in FIG. 9, the fixed ribbon guide comprises pin like guide elements 42, 43 and 44 on a bracket 45 attached to the frame member 20*a* between the end of type band 30 and front spool housing 35. As in the case of the guide pin 39 of the movable ribbon guide means, guide element 42 is parallel with the axis of spool 37 to maintain ribbon 14 in proper alignment with spool 37. Guide element 43, like guide pin 40 has a surface normal to ribbon 14 and parallel with the surface of type band 30. Guide element 43 is also parallel with guide pin 40 when cover member 34*b* is closed. Guide element 44 like guide pin 41 is a transition pin and is slanted in the same manner as previously described for guide pin 41.

Figure 5:
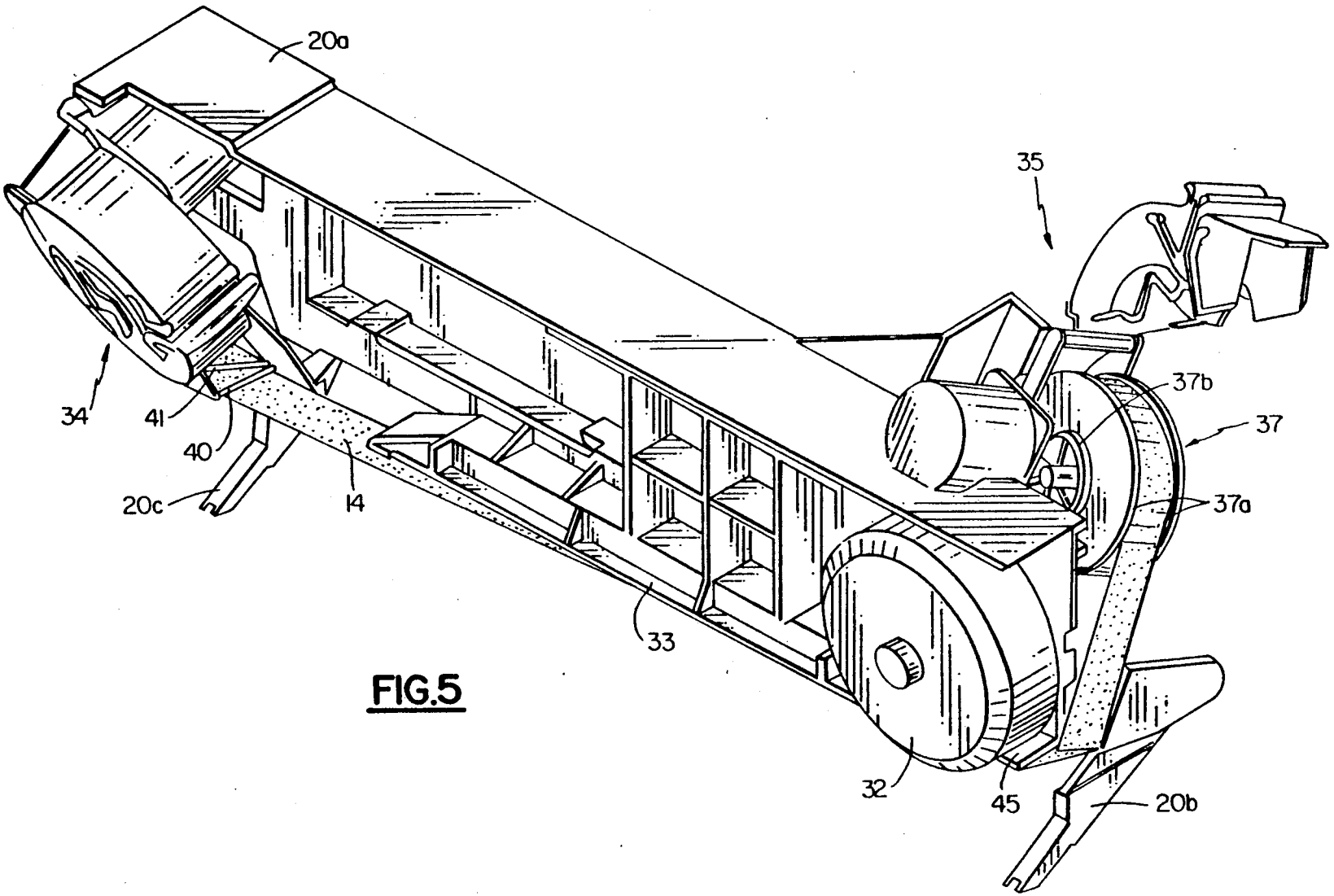
Figure 6:
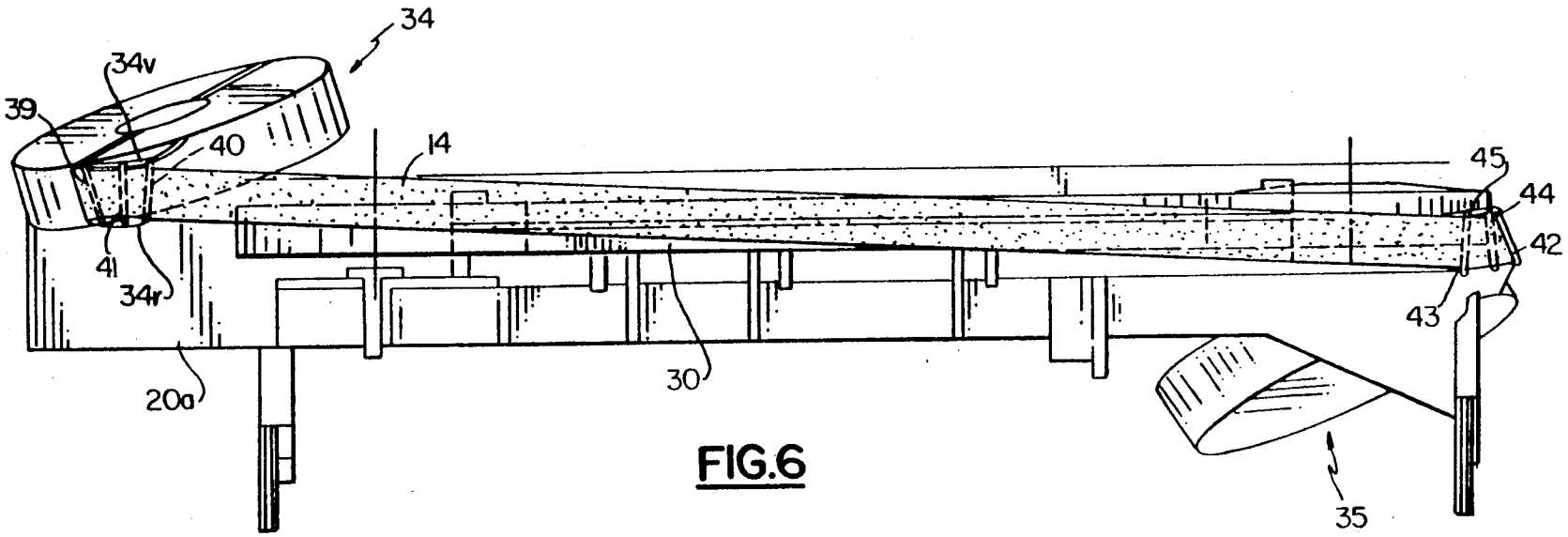
FIG. 6 is a bottom plan view of the ribbon drive and band drive assembly of FIG. 3.

Referring to FIG. 5, ribbon is installed in print unit 11 by opening cover member 34*b* on back spool housing 34 and cover member 35*b* on front cover member 35, and holding both spools 36 and 37 by their flanges, spool 36 is dropped into housing member 34*a* so that spool gear 36*b* engages the gearing on the drive motor and then cover member 34*b* is swung closed and locked. When closing, the ribbon guide, formed by flanges 34*u* and 34*v*, catches and and the guide pins 39–41 engage the top of the ribbon 14 as previously described and positions ribbon 14 at the proper level so as to be aligned with the gap at the back of frame member 20*a*. Holding the spool 37 by the flanges 37*a*, a stretch of ribbon 14 is drawn from spool 36 along the side of frame member 20*a* and, while holding the ribbon somewhat taut, ribbon 14 is brought under, aligned with and wrapped around the guide elements 42–44 of the fixed guide and spool 37 is dropped into the housing member 35*a* of front spool housing 35 on the other side of frame member 20*a*. Cover member 35*b* is swung closed and locked to complete the installation process. For replacement, the process is reversed by removing spool 37 from housing 35 and, after opening cover member 34*b* of back spool housing 34, removing spool 36 from housing member 34*a*.

Thus it can be appreciated that the invention provides a ribbon drive system in which the ribbon is accurately guided along the print line and in which the ribbon and spools therefor can be easily and cleanly installed and removed from the ribbon drive system. While the invention has been described with reference to a single embodiment, it will readily occur to a person skilled in the art that various changes can be made for uses in the same or other embodiments and printer devices without departing from the scope of the invention as defined in the following claims.

What is claimed is:

1. In a printer apparatus having a print mechanism comprising a row of print hammers, a type carrier drive and an endless type carrier having a portion extending parallel with said row of hammers with a gap therebetween sufficient for passage of a print medium including an ink ribbon therebetween, the combination comprising a frame member for supporting said type carrier drive with said parallel portion of said type carrier in alignment with said row of print hammers, and a ribbon drive mounted on said frame member for feeding a strip of ribbon lengthwise between said portion of said type carrier and said print hammers comprising a pair of ribbon spools with a length of ribbon wound thereon, a spool housing means mounted on each end of said frame member, each of said spool housing means having a housing member for rotatably supporting one of said spools and a hinged member connected to said housing member for movement between open and closed positions, and a ribbon guide system comprising a first ribbon guide means mounted on said frame member proximate one of said spool housing means for positioning said ribbon at one end of said type carrier and a second ribbon guide means movable with said hinged member of a second spool housing means for catching and positioning said ribbon at the other end of said type carrier when moved from said open to said closed positions.

2. A print apparatus comprising a row of print hammers, a frame member for supporting an endless type band in spaced alignment with said row of hammers with a gap therebetween, and a ribbon drive mechanism mounted on said frame member for feeding a printing ribbon along a path of travel lengthwise through said gap, a pair of ribbon spools and a length of ribbon wound on said spools, housing means mounted on said frame member for housing said spools separately at opposite ends of said type carrier with a portion of said ribbon extending between said spools and lengthwise through said gap, said housing means comprising receptacle members for receiving and rotatably supporting said ribbon spools and a cover member hingedly connected to each of said receptacle members, said cover members having an open position for allowing placement of said ribbon spools into and a closed position for retaining said ribbon spools within said receptacle members, and a ribbon guide system comprising a fixed ribbon guide means on said frame member proximate one housing means for positioning said ribbon at one end of said type carrier and a movable ribbon guide means on said cover member of another of said housing means at said other end of said type carrier for engaging and positioning said ribbon when said hinged cover member is in closed position.

3. A printer apparatus in accordance with claim 2 wherein said housing means are mounted on said frame member on opposite sides of said aligned type carrier and said row of hammers, and said fixed and said movable ribbon guide means each comprise a plurality of guide elements arranged for establishing a path of travel for said ribbon through said gap which is parallel with said row of print hammers and at an angle to the line of said type carrier and said row of hammers whereby the entire width of said ribbon is presented for printing when fed through said gap.

4. A printer apparatus in accordance with claim 2 wherein said ribbon drive further comprises drive motors mounted on said housing members of said spool housing means for drivingly engaging said ribbon spools installed in said housing members.

5. A printer apparatus in accordance with claim 3 wherein said ribbon has a first surface for contacting said type band and a second surface for contacting paper within said gap, and said plurality of guide elements of said fixed and movable ribbon guide means have guide surfaces in engagement with said first surface of said ribbon.

6. A printer apparatus in accordance with claim 5 wherein said fixed and movable ribbon guide means each have a first guide element with a guide surface in engagement with said first surface and which is parallel with an axis of a spool.

7. A printer apparatus in accordance with claim 5 wherein said fixed and movable ribbon guide means on opposite ends of said type carrier each have a second guide element with a guide surface in engagement with said first surface of said ribbon which is normal to the path of travel of said ribbon through said gap.

8. A printer apparatus in accordance with claim 5 wherein said spools are rotatably supported within said receptacle members of said housing means and have a rotation axis tilted at an acute angle on opposite sides of the vertical plane of said frame member.

9. A printer apparatus in accordance with claim 7 wherein said fixed and movable ribbon guide means each have a third guide element between said first and second guide elements, said third guide element having a guide surface arranged at an angle relative to said first and second guide elements whereby said ribbon moves from the plane of said first guide element to the plane of said second guide element without urging the ribbon in either direction along the guide elements.

10. A printer apparatus in accordance with claim 6 wherein said receptacle member has a bearing edge in contact with said second surface of said ribbon as it leaves said spool housing member, and said first guide element of said movable ribbon guide when said cover member is closed engages said first surface of said ribbon so as to impose a reverse bend in said ribbon as it moves from said spool housing member.

11. A printer apparatus in accordance with claim 2 wherein said movable guide means on said cover member of said spool housing means comprises channel forming means on said cover member, and a plurality of ribbon guide elements supported by said channel forming means for catching and positioning said ribbon when said cover member is closed.

12. A printer apparatus in accordance with claim 11 wherein said channel forming means comprises spaced parallel flange elements forming a channel on said cover member, and said guide elements are supported between said flange elements within said channel.

* * * * *